US006289780B1

(12) United States Patent
Heldmann

(10) Patent No.: US 6,289,780 B1
(45) Date of Patent: Sep. 18, 2001

(54) DEVICE FOR ADJUSTING A FUSE WITHOUT ACTUALLY TOUCHING IT IN THE TIP OF A LARGE-CALIBER PROJECTILE

(75) Inventor: Heinrich Heldmann, Kassel (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 0 days.

(21) Appl. No.: 09/480,366

(22) Filed: Jan. 10, 2000

(30) Foreign Application Priority Data

Jan. 18, 1999 (DE) ..... 199 01 673

(51) Int. Cl.[7] ..... F42C 17/00
(52) U.S. Cl. ..... 89/6.5; 89/6
(58) Field of Search ..... 89/6.5, 6; 235/408

(56) References Cited

U.S. PATENT DOCUMENTS 1,307,639 * 6/1919 Redpath et al. ..... 89/6.5
1,863,659 * 6/1932 Johenning ..... 89/6
1,946,487 * 2/1934 Dabrasky ..... 89/6
2,438,165 * 3/1948 Haas ..... 89/6
2,887,011 * 5/1959 Harvey et al. ..... 89/6.5
5,343,795 * 9/1994 Ziemba et al. ..... 89/6.5

* cited by examiner

*Primary Examiner*—Charles T. Jordan
*Assistant Examiner*—John W. Zerr
(74) *Attorney, Agent, or Firm*—Chadbourne & Parke LI

(57) ABSTRACT

A device for adjusting a fuse in the tip of a large-caliber projectile without actually touching it. The device is provided with a programming station that has an annular or cylindrical programming coil mounted on it coaxially with the longitudinal axis of the resting projectile and communicating with electric controls. The tip of the projectile extends into the coil at least while the fuse is being adjusted. The programming coil slides back and forth axially paralleling the resting projectile relative to the programming station. A Y shaped grip that secures the projectile is positioned facing the side of the coil toward the projectile. The grip is shaped to accommodate the tip of the projectile. The grip moves along with and axially parallels the coil. The tip of the projectile fixes the projectile grip when it is accommodated therein. The coil can be moved out of a disengaged position relative to the projectile grip and into a fuse-measuring position wherein the distance between the projectile grip and the coil is established by stops.

8 Claims, 3 Drawing Sheets

DEVICE FOR ADJUSTING A FUSE WITHOUT ACTUALLY TOUCHING IT IN THE TIP OF A LARGE-CALIBER PROJECTILE

BACKGROUND OF THE INVENTION

The present invention concerns a device for adjusting a fuse without actually touching it in the tip of a large-caliber projectile, wherein the device is provided with a programming station that has an annular or cylindrical programming coil mounted on it coaxially with the longitudinal axis of the resting projectile and communicating with electric controls, the tip of the projectile extending into the coil at least while the fuse is being adjusted.

Armored howitzers are described in European Patent 0 331 980 B1 and German Patent 2 642 920 C2 for example. A mechanism automatically transfers their projectiles from a magazine to the rear of the weapon. The fuse must be automatically adjusted at a prescribed point along this route prior to ramming, conventionally by a programming coil connected to electric controls while the tip of the projectile extends into the coil. The projectiles are usually deposited in a tilting tray with the programming station at one end. It is, however, not easy to ensure that the tips come to rest precisely inside the coil when the fuses of several projectiles of different lengths are being adjusted. Furthermore, delicate fuses can be damaged when the projectiles are thrust into the coil at high speeds and braked therein.

SUMMARY OF THE INVENTION

The object of the present invention is accordingly an improved device of the aforesaid type for adjusting the fuses without actually touching them in large-caliber projectiles, wherein the device will trim the programmable fuses without actually touching them in projectiles of different length employed in particular in howitzers with automatic projectile transfer, wherein the fuse will always be at the same distance from the coil no matter how long the projectile is and wherein the fuse cannot be damaged as it enters the coil.

This object is attained in accordance with the present invention in that the programming coil slides back and forth axially paralleling the resting projectile relative to the programming station and by a Y-shaped grip that secures the projectile, that is positioned facing the side of the coil toward the projectile, that is shaped to accommodate the tip of the projectile, and that moves along with and axially parallels the coil, such that, with the tip of the projectile fixing the projectile grip when it is accommodated therein, the coil can be moved out of a disengaged position relative to the projectile grip and into a fuse-measuring position wherein the distance between the projectile grip and the coil is established by stops. Advantageous advanced embodiments of the present invention will be specified hereinafter by way of examples.

This basic theory behind the present invention is, rather than shifting it into the programming coil, to secure the projectile at its tip with the projectile grip and then to move the coil axially until it arrives in its fuse-measuring position where it is halted by stops at a prescribed distance from the fuse, which can then be adjusted without actually being touched.

Once the programming coil has been moved back out of the fuse measuring position, the projectile can be tilted up and removed from the projectile grip for forwarding. With shorter projectiles, the tips of which are farther from the programming station while they are resting in the tray, the coil and projectile grip are initially moved toward the projectile until the projectile grip comes into contact with a prescribed point on the projectile and is accordingly fixed, upon which the coil is moved farther toward the projectile grip and into its fuse-measuring position.

As the programming coil moves toward the projectile grip, the stop ensures that the distance between the fuse and the coil remains constant, preventing any contact between them. One embodiment of the present invention will now be specified by way of example with reference to the accompanying drawing, wherein:

DETAILED DESCRIPTION OF THE INVENTION

Figure 1:
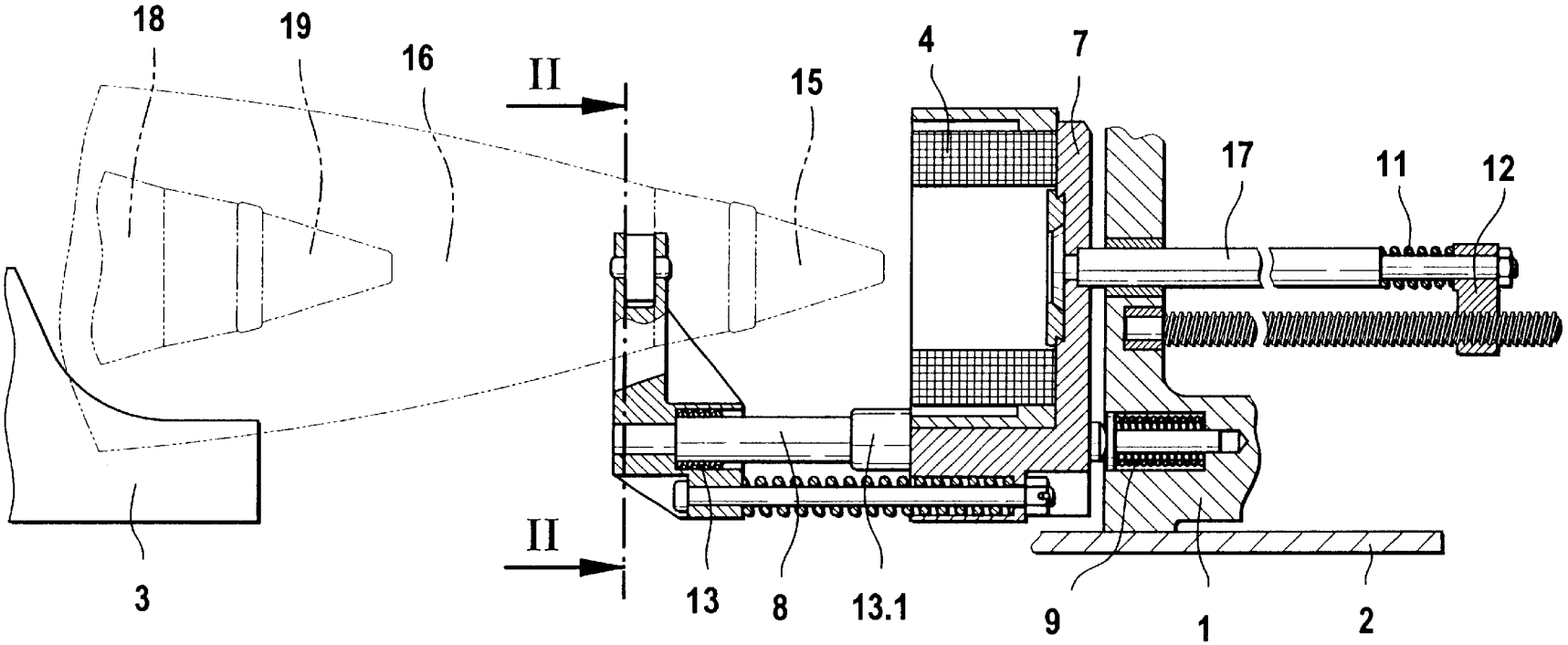
FIG. 1 is a partly axially sectional view of a device according to the invention for adjusting fuses without actually touching them and of a large-caliber bore with the programming coil disengaged.
Figure 2:
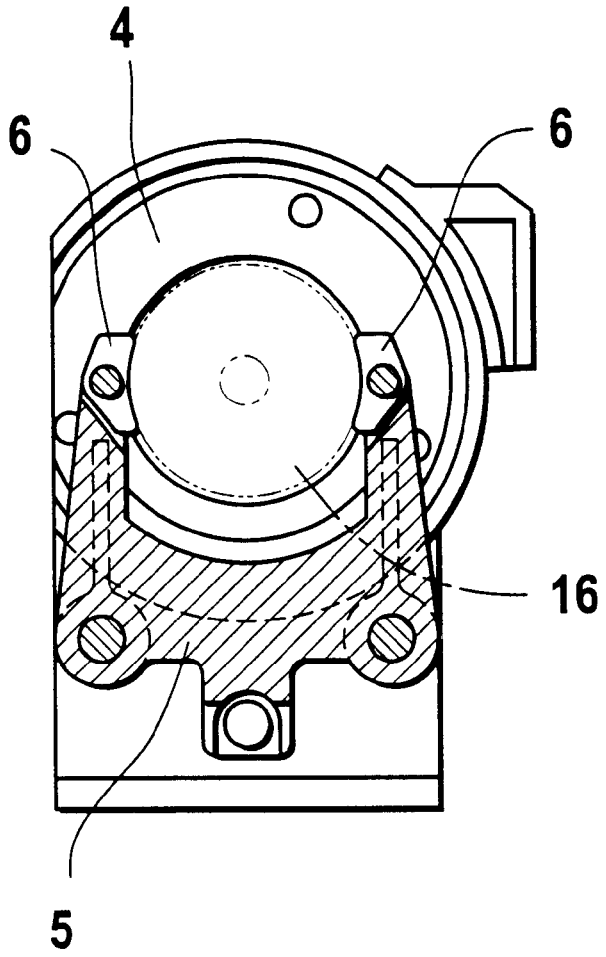
FIG. 2 is a section along the line II—II in FIG. 1.
Figure 3:
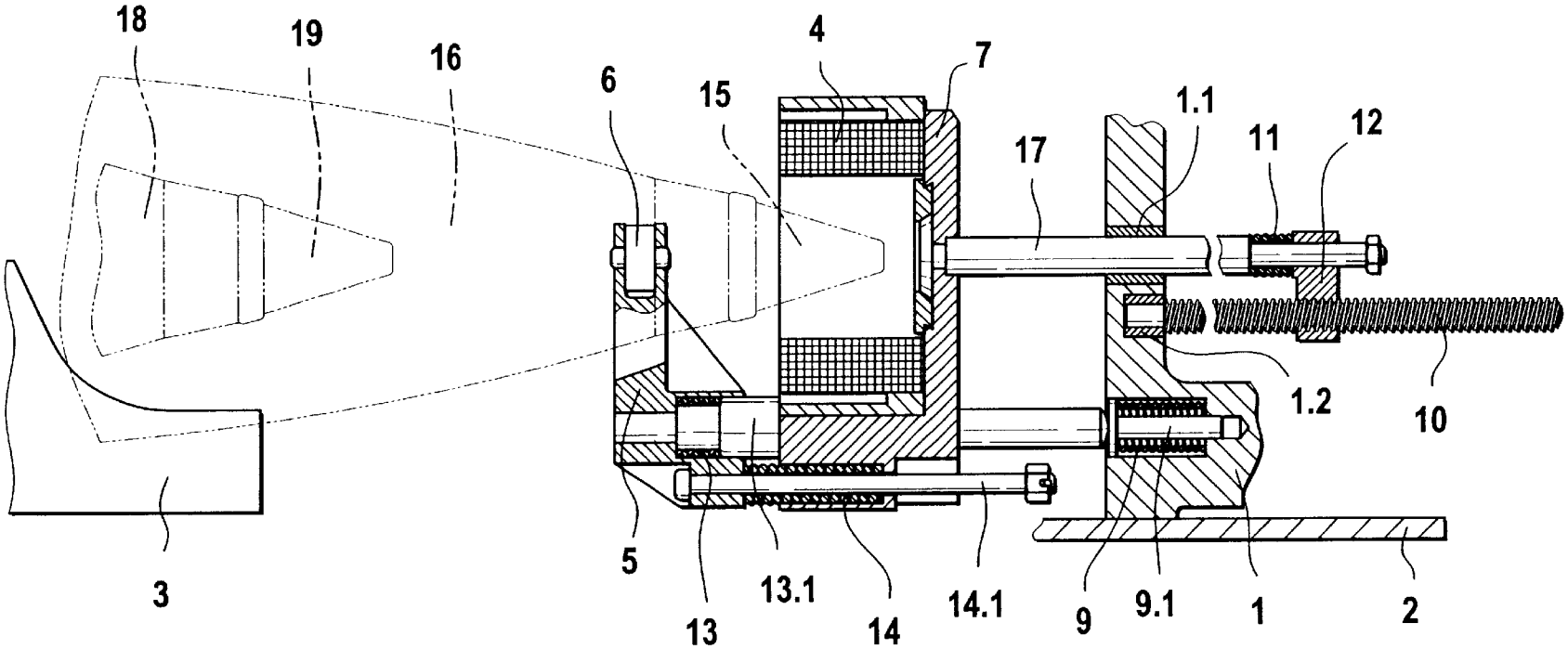
FIG. 3 is a view similar to the one in FIG. 1, but showing the programming coil in the fuse-measuring position.

The device illustrated in FIGS. 1 through 3 is provided with a programming station 1 mounted on a flat horizontal base 2 and axially facing a tilting tray 3. A large-caliber projectile represented by dot-and-dash lines, either a longer projectile 16, with an adjustable fuse 15 or a shorter projectile 18 with a fuse 19, rests in tray 3.

Mounted on programming station 1 and moving axially toward and away from it is a programming head 7. Head 7 accommodates an annular or cylindrical programming coil 4. The head is secured to the ends of two parallel rods 17. The axes of rods 17 extend along a horizontal plane that also accommodates the longitudinal axis of projectile 16 or 18. The rods slide back and forth through bearings 1.1 in programming station 1. The head is advanced and retracted and the coil accordingly moved toward and away from the programming station by a helical gear with a threaded shaft 10 that parallels rods 17. One end of shaft 10 rotates in a bearing 1.2 in programming station 1. Its other end is coupled to an unillustrated motor. Mounted on the shaft is a nut 12 that can travel back and forth on the ends of rods 17 and is forced against them by compression springs 11.

Facing the side of programming coil 4 toward projectile 16 or 18 is a projectile grip 5 with pivoting arms 6. The facing edges of arms 6 are shaped and separated far enough apart to fit against the ogival surface of projectile 16 or 18 just behind fuse 15. The projectile can accordingly be secured in a prescribed position with its tip and hence its fuse always projecting a specified distance out of the projectile grip and toward the programming coil.

Projectile grip 5 is mounted on a guide comprising two parallel bolts 8 that slide in and out through programming head 7. Bolts 8 are long enough to project out of head 7 and toward programming station 1 as long as programming coil 4 is in the fuse-measuring position represented in FIG. 3. In this state, the ends of the bolts will either face the opposing wall of programming station 1 or rest against it, depending on the length of the projectile. Buffers in the form of spring-loaded shock absorbers are positioned on the side of the programming station facing the bolts. The buffers are provided with a thruster 9.1 maintained in position by compression spring 9.

Programming head 7 and coil 4 advance toward projectile grip 5 against the force exerted by a compression spring 14.

Compression spring 14 is mounted around a bolt 14.1 that extends between the projectile grip and the head. The travel of programming coil 4 toward programming projectile grip 5 is limited in the fuse-measuring position by a stop 13 mounted on the projectile grip and coming to rest against an opposing stop 13.1 mounted on head 7.

The operation of the device hereintofore specified will now be specified in turn.

When a longer projectile 16 is to be loaded, it is laid in tray 3 with programming head 7 and programming coil 4 in the disengaged positions illustrated in FIG. 1 and with its surface grasped by the arms 6 of programming coil 4 at a prescribed point just behind fuse 15 and secured in that position, outside coil 4, that is, as will be evident from FIG. 1.

The threaded shaft will now advance head 7 into the fuse-measuring position represented in FIG. 3 until stop 13 comes into contact with its opposing stop 13.1. The motion occurs against the force of spring 14 and intermittently of that of the spring 11 mounted on the shaft. As will be evident from FIG. 3, fuse 15 will now be inside the coil, which is connected in an unillustrated manner to electric controls, and can accordingly be adjusted.

Once fuse 15 has been adjusted, programming head 7 is retracted into the disengaged position illustrated in FIG. 1, with the fuse outside programming coil 4. Projectile 16 can now be tipped up out of the way. The device in accordance with the present invention allows the projectile to be advanced strictly mechanically through head 7 with no need for such complications as rotary helical gears, sensors, etc. while maintaining the coil in the fuse-measuring position at the correct distance from the fuse.

The forces exerted by the compression springs 11 on the threaded shaft and by the spring 14 between projectile grip 5 and head 7 will prevent the projectile and the fuse inside it from slipping back or forth in relation to the coil during the procedure.

The device in accordance with the present invention also prevents force from being exerted on the programming head 7 or coil 4 when a projectile 16 is positioned in programming projectile grip 5. When an attempt is made to introduce a projectile that is too long or too far forward in tray 3, the forces that would be exerted on projectile grip 5 are transmitted directly to spring 9 and thruster 9.1 by bolts 8, preventing stress on coil 4 or fuse 15.

When a shorter projectile 18 is to be loaded, the threaded shaft advances programming head 7, coil 4, and projectile grip 5 toward the projectile until the projectile grip's arms 6 engage the ogive behind fuse 19. Head 7 and coil 4 will now advance toward projectile 18 and in relation to projectile grip 5 as hereinbefore specified until the projectile grip arrives in the fuse-measuring position established by stops 13 and 13.1. As will be evident from the Figures, the distance between fuse 19 and coil 4 will now be precisely what it should be.

Head 7 will now retract, and shorter projectile 18 can now be tilted up and rammed.

What is claimed is:

1. A device for adjusting a fuse in the tip of a large-caliber projectile without actually touching it, comprising: a programming station having an annular or cylindrical programming coil mounted thereon coaxially with a longitudinal axis of a resting projectile and in communication with electric controls, the coil configured such that the tip of a projectile can extend into the coil at least while the fuse is being adjusted, wherein the programming coil slides back and forth axially paralleling a resting projectile relative to the programming station and a Y-shaped grip for securing the projectile and positioned facing a side of the coil toward the projectile, wherein the grip is shaped to accommodate the tip of the projectile and moves along with and axially parallels the coil such that the tip of the projectile fixes the projectile grip when it is accommodated therein, and the coil is moveable out of a disengaged position relative to the projectile grip and into a fuse-measuring position wherein the distance between the projectile grip and the coil is established by stops.

2. The device as in claim 1, wherein the projectile grip is mounted on a guide extending through a programming head that accommodates the programming coil.

3. The device as in claim 1, wherein the programming coil moves toward the projectile grip against the force of a spring.

4. The device as in claim 2, wherein the guide comprises two parallel bolts that slide in and out through the programming head and are sufficiently long to project out of the head and toward the programming station when the programming coil is in the fuse-measuring position and buffers positioned on the side of the programming station facing the bolts.

5. The device as in claim 4, wherein the buffers are spring-loaded shock absorbers.

6. The device as in claim 2, wherein the programming coil is advanced toward the programming station by a helical gear.

7. The device as in claim 6, wherein the programming head is secured to the ends of two parallel rods with axes extending along a plane that accommodates the axis of the projectile, wherein the rods slide back and forth through bearings in the programming station and are engaged by a nut, wherein the nut engages a threaded shaft in the helical gear and the shaft parallels the rods and rotates in a bearing in the programming station.

8. The device as in claim 7, wherein the nut is forced against the rods by compression springs.

* * * * *